313-423 SR

11/4/86 XR 4,621,215

United States Patent [19]

Tanaka

[11] Patent Number: 4,621,215

[45] Date of Patent: Nov. 4, 1986

[54] CONVERGENCE SYSTEM FOR A MULTI-BEAM ELECTRON GUN

[75] Inventor: Sakae Tanaka, Tokyo, Japan

[73] Assignee: Sony Corporation, Tokyo, Japan

[21] Appl. No.: 555,873

[22] PCT Filed: Mar. 10, 1983

[86] PCT No.: PCT/JP83/00073

§ 371 Date: Nov. 16, 1983

§ 102(e) Date: Nov. 16, 1983

[87] PCT Pub. No.: WO83/03162

PCT Pub. Date: Sep. 15, 1983

[30] Foreign Application Priority Data

Mar. 10, 1982 [JP] Japan ..... 57-37455

[51] Int. Cl.[4] ..... H01J 29/70

[52] U.S. Cl. ..... 313/422; 313/428

[58] Field of Search ..... 313/422, 412, 428, 431, 313/433

[56] References Cited

U.S. PATENT DOCUMENTS

| | | | |
|---|---|---|---|
| 3,181,027 | 4/1965 | Geer | 313/422 X |
| 3,949,262 | 4/1976 | Ohkoshi et al. | 313/412 |
| 4,451,756 | 5/1984 | Sato et al. | 313/422 |

*Primary Examiner*—David K. Moore
*Assistant Examiner*—K. Wieder
*Attorney, Agent, or Firm*—Hill, Van Santen, Steadman & Simpson

[57] ABSTRACT

A multi-beam electron gun is disclosed in which a pair of outer electrodes of a convergence means (C) for converging a plurality of electron beams are divided into front and rear electrodes in the advancing direction of the electron beams and the dynamic convergence compensation of electron beams is carried out by electrodes ($C_{3B}$), ($C_1$) and ($C_{4B}$), ($C_2$), respectively.

1 Claim, 9 Drawing Figures

CONVERGENCE SYSTEM FOR A MULTI-BEAM ELECTRON GUN

TECHNICAL FIELD

The present invention relates to a multi-beam electron gun having a common main electron lens to converge a plurality of electron beams and particularly to a multi-beam electron gun suitable for use with a flat type color cathode ray tube.

BACKGROUND ART

A flat type color cathode ray tube is provided with an electron gun which is extended along the direction parallel to the surface of a phosphor screen to make an envelope flat. The flat type cathode ray tube of this kind includes a flat tube envelope 1 as shown in FIGS. 1 and 2. This tube envelope 1 comprises, for example, a glass panel portion 1*a*, a glass funnel portion 1*b*, which forms a flat cavity 2 between the former and the latter and is made narrower as it comes closer to one side, namely, made as the form of a funnel (funnel shaped), and a glass neck portion 1*c* which is located at one narrow side thereof to communicate with the flat cavity 2.

Within the flat envelope 1 are placed a phosphor screen 3 and an opposing electrode 4 facing to the phosphor screen on its flat surface in the flat cavity 2. Both of them are placed in parallel to each other relative to the direction perpendicular to the flat surface of the tube envelope 1. On the inner surface of the panel portion 1*a*, for example, of the tube envelope 1 are deposited a target electrode 5 made of, for example, a transparent electrode and the phosphor screen 3 and the opposing electrode 4 made of, for example, a metal plate is located on the inner surface of the funnel portion 1*b* to oppose the former.

The phosphor screen 3 comprises stripe or dot like predetermined phosphor patterns which will emit, for example, red, green and blue light. In facing relation to this phosphor screen 3, an electrode 13 which determines an electron beam landing position, for example, aperture grille or shadow mask and the like is located to allow electron beams corresponding to respective color, which will be described later, to land on the phosphors of corresponding colors.

On the other hand, an electron gun 7 is located within the neck portion 1*c*, which is arranged such that electron beams emitted from the electron gun pass through the substantially center between the phosphor screen 3 and the opposing electrode 4 and then extends along the direction parallel to the surface of the phosphor screen 3.

The electron gun 7 can be constructed as a multi-beam single electron gun in which, as shown in FIGS. 3 and 4, three cathodes $K_R$, $K_G$ and $K_B$ corresponding to, for example, red, green and blue colors are arranged on the horizontal plane, namely, in line with one other. A first grid $G_1$, a second grid $G_2$, a third grid $G_3$, a fourth grid $G_4$ and a fifth grid $G_5$ which are common thereto are located in turn. The third to fifth grids $G_3$ to $G_5$ constitute a main electron lens L of, for example, the unipotential type and a convergence means C is located at the rear stage of the fifth grid $G_5$. The convergence means C comprises a pair of inner deflection plates $C_1$ and $C_2$ which are arranged symmetrically on both sides of the axis of the electron gun 7, namely, on the plane substantially perpendicular to the phosphor screen and are symmetrical to each other in the longitudinal direction relative to the horizontal plane passing through the axis of the electron gun 7. Outside the respective deflection paltes $C_1$ and $C_2$ located are a pair of outer deflection plates $C_3$ and $C_4$, each of which is opposed in parallel relation to the deflection plates $C_1$ and $C_2$, are similarly arranged along the above mentioned plane perpendicular to the phosphor screen and are symmetrical to each other on both sides of the axis of the electron gun. In addition, they are arranged symmetrical to each other in the longitudinal direction relative to the horizontal plane passing through the axis of the electron gun. The pair of inner deflection plates $C_1$ and $C_2$ are electrically coupled to the fifth grid $G_5$ of the last stage to which a high voltage is applied. Between the inner deflection plates $C_1$, $C_2$ and the outer deflection plates $C_3$ and and $C_4$ applied is a deflection voltage.

A high anode voltage is applied to a target electrode 5, namely, the phosphor screen 3 and a high voltage lower than the above anode voltage are applied to the opposing electrode 4, thus forming a first deflection field between the phosphor screen 3 (the target electrode 5) and the opposing electrode 4.

A second deflection field is constructed between the electron gun 7 and the position of the phosphor screen 3. The second deflection field deflects the electron beams emitted from the electron gun 7, for example, three electron beams $b_R$, $b_G$ and $b_B$ in the horizontal and vertical directions. The horizontal deflection is such deflection that the electron beam from the electron gun 7 is deflected in the direction substnatially perpendicular to the axial direction of the electron gun 7 and in the direction parallel to the surface of the phosphor screen 3 to perform a so-called horizontal scanning on the phosphor screen 3. Meanwhile, the vertical deflection is such deflection that the same beam is deflected in the direction perpendicular to the horizontal deflection to perform a vertical scanning on the phosphor screen 3. Reference numeral 8 designates a deflection means which forms the second deflection field. The horizontal deflection which requires, for example, a relatively large deflection angle is carried out by the electromagnet deflection, while the vertical deflection is carried out by the electrostatic deflection. This deflection means 8 is electromagnet and electrostatic deflection type.

The deflection means 8, as shown in FIGS. 1 and 2, consists of an annular magnetic core 9 made of, for example, ferrite having high magnetic permeability surrounding the outer periphery of the tube envelope 1 at the rear stage of the electron gun 7, an electromagnet coil 10 passing therethrough the horizontal deflection current and a pair of deflection plates 11*a* and 11*b* made of, for example, high magnetic permeability magnetic material such as Mn—Zn ferrite, Ni—Zn ferrite or the like whitin the tube envelope 1 to serve as the inner pole pieces and electrostatic deflection plates.

The deflection plates 11*a* and 11*b* are located to oppose to each other in the direction perpendicular to the flat surface of the tube envelope 1 at the both sides of the passage of the electron beam, namely, located in parallel to the opposing electrode 4 and the phosphor screen 3. The magnetic core 9 is formed as the annular shape surrounding the outer periphery of the tube envelope 1 and includes outer center poles 12*a* and 12*b* which grip the deflection plates 11*a* and 11*b* within the tube envelope 1 to project to the inside so as to oppose to each other. Around the outer peripheries of the outer center poles 12*a* and 12*b* is wound at least one of coils 10*a* and 10*b*. With the construction thus made, the horizontal deflection current is flowed to the coil 10 (10*a* and 10*b*) thereby to establish between both the outer center poles 12*a* and 12*b* and further between the inner pole pieces and electrostatic deflection plates 11*a* and 11*b* existing therebetween the horizontal deflection magnetic field which transverse the passage of the electron beam in the direction perpendicular to the flat surface of the envelope 1. On the other hand, the vertical deflection signal voltage is applied between the deflection plates 11*a* and 11*b* to thereby establish the electrostatic vertical deflection field to the passage of the electron beam in the direction perpendicular to the flat surface of the envelope 1.

The electron beams $b_R$, $b_G$ and $b_B$ emitted from the respective cathodes $K_R$, $K_G$ and $K_B$ of the electron gun 7 intersect with one another at substantially the center of the main electron lens L and then pass therethrough. After that, the electron beams $b_R$, $b_G$ and $b_B$ are diverged and travelled through between the deflection plates $C_2$ and $C_4$, $C_1$ and $C_2$, $C_1$ and $C_3$ of the convergence means C. The deflection voltage applied between the inner deflection plates $C_1$, $C_2$ and the outer deflection plates $C_3$, $C_4$ permit three beams $b_R$, $b_G$ and $b_B$ to be concentrated (converged) on substantially the phosphor screen 3. Strictly speaking, three beams $b_R$, $b_G$ and $b_B$ are converged at a beam throughhole of the electrode 13 which determines the electron beam landing position which is located to face the phosphor screen 3. Due to the differences of the incident angles of the beams $b_R$, $b_G$ and $b_B$ on this electrode 13, the beams $b_R$, $b_G$ and $b_B$ are respectively landed on the phosphors of the corresponding colors of the phosphor screen 3. On the other hand, since these electron beams $b_R$, $b_G$ and $b_B$ emitted from the electron gun 7 are passed through the second deflection system generated by the horizontal and vertical deflection means 8, they are deflected in the horizontal and vertical directions. Further, these electron beams are deflected in the direction towards the phosphor screen 3 by the first deflection system established between the target electrode 5 (the phosphor screen 3) and the opposing electrode 4 at the rear stage. The cooperation of the first and second deflection systems allows the electron beams $b_R$, $b_G$ and $b_B$ to scan the phosphor screen 3 in the horizontal and vertical directions. As described above, the color image produced on the phosphor screen 3 by the scanning of the electron beams is observed from the side of, for example, the panel 1*a*.

When the main electron lens is made common, each beam is arranged on the same plane and the concentration of each beam near the phosphor screen is performed on the surface perpendicular to the axis of the electron gun, the construction of the electron gun becomes simple. However, as described above, when this electron gun is applied to the flat type cathode ray tube in which the electron gun is located in the direction parallel to the phosphor screen, the travelling distance of the electron beam becomes considerably different relative to the vertical scanning direction of the phosphor screen. Namely, when each beam is converged at the beam throughhole of the electrode 13 which determines the beam landing position in a certain place in the vertical scanning direction of the phosphor screen, the beam is not converged at the beam through-holes in other places. For example, when each beam is exactly converged at the center of the phosphor screen 3, in the portion of the phosphor screen 3 farthest from the electron gun 7, each beam is converged in fron of the electrode 13, while in the portion of the phosphor screen nearest to the electron gun 7, each beam is converged behind the electrode 13. As a result, each beam is mislanded. Therefore, a socalled dynamic convergence compensation is necessary for changing the converging position of each beam in accordance with the change of the scanning position.

DISCLOSURE OF THE INVENTION

The present invention is to provide a multi-beam electron gun suitable for the flat type color cathode ray tube.

Further, the present invention is to provide a multi-beam electron gun capable of automatically performing the dynamic convergence compensation of the electron beam.

Figure 2:
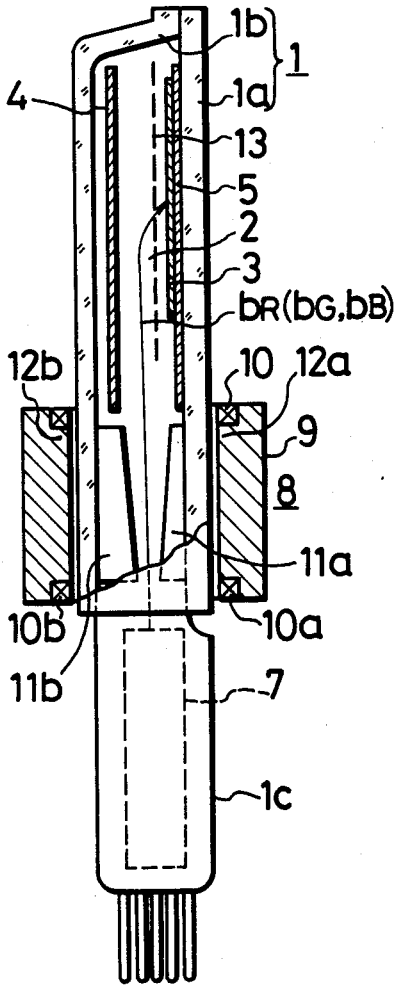
FIGS. 1 and 2 are a front view of a flat type cathode ray tube and a partially cross-sectional side view thereof useful for explaining the present invention.

Reference numeral 17 designates the electron gun, $K_R$, $K_G$ and $K_B$ the cathodes thereof, $G_1$ to $G_5$ the first to fifth grids and C the convergence means of electron beam.

BEST MODE FOR CARRYING OUT THE INVENTION

Figure 1:
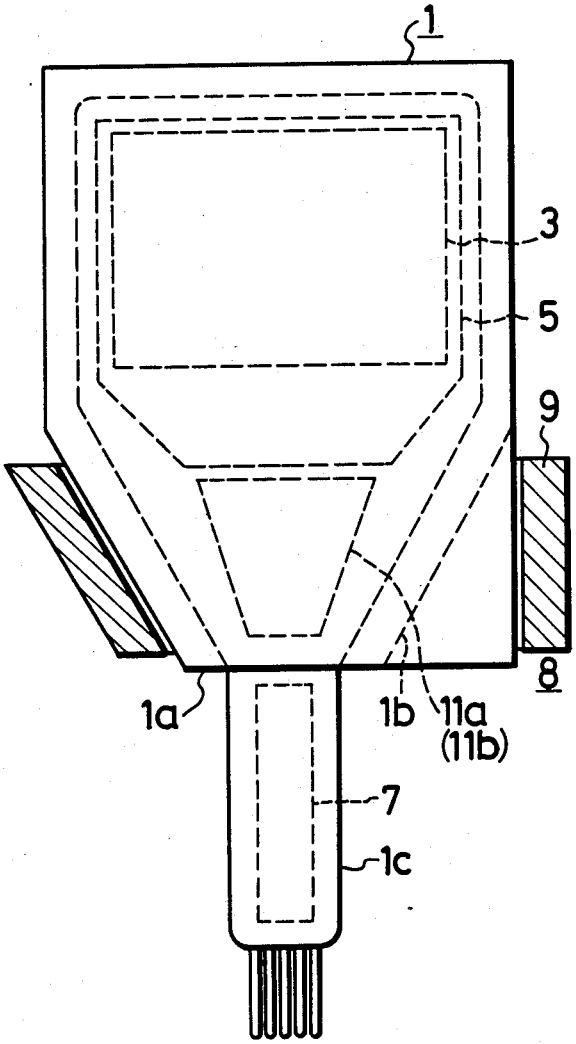
Figure 3:
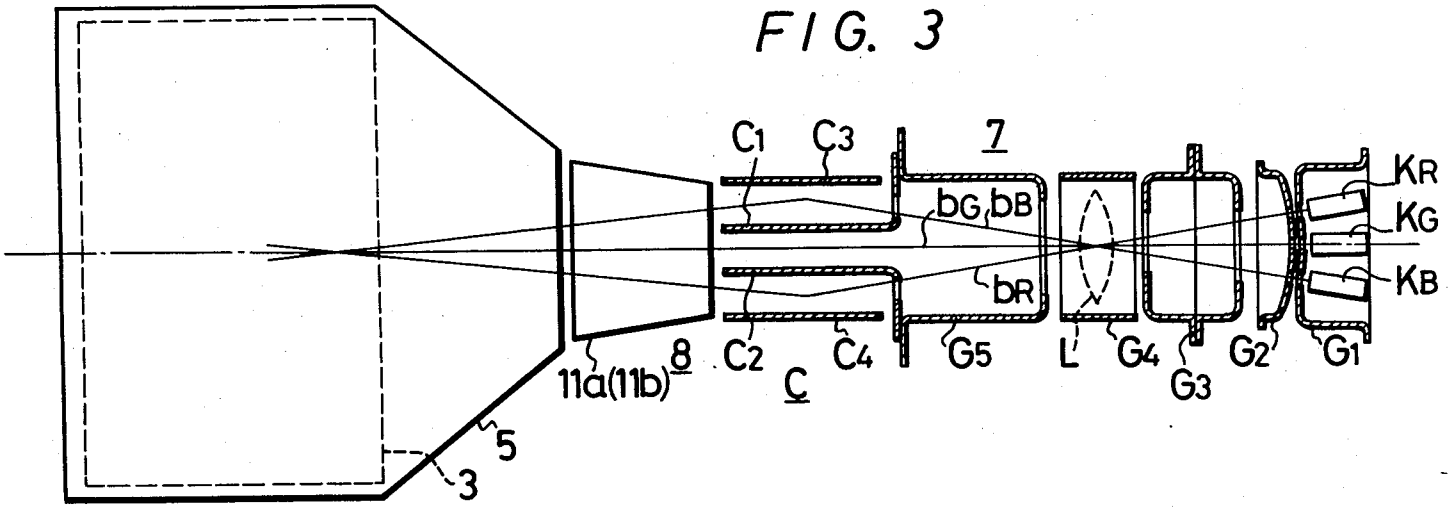
FIG. 3 is a partially cross-sectional side view of the electron gun thereof.
Figure 4:
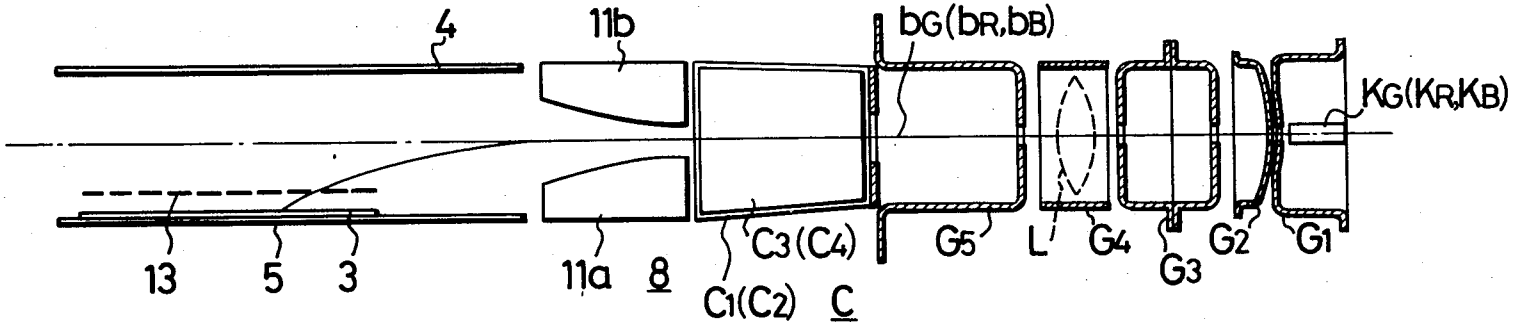
FIG. 4 is a partially cross-sectional other side view of the same.
Figure 5:
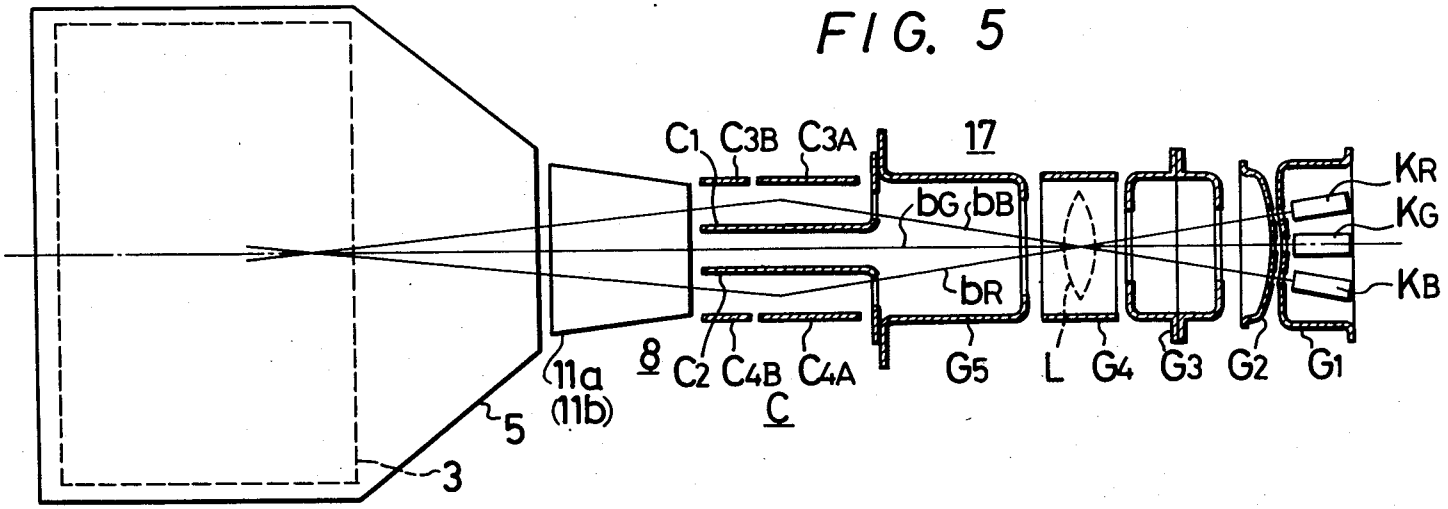
FIG. 5 is a partially cross-sectional one side view illustrating an embodiment of a multi-beam electron gun according to the present invention.
Figure 6:
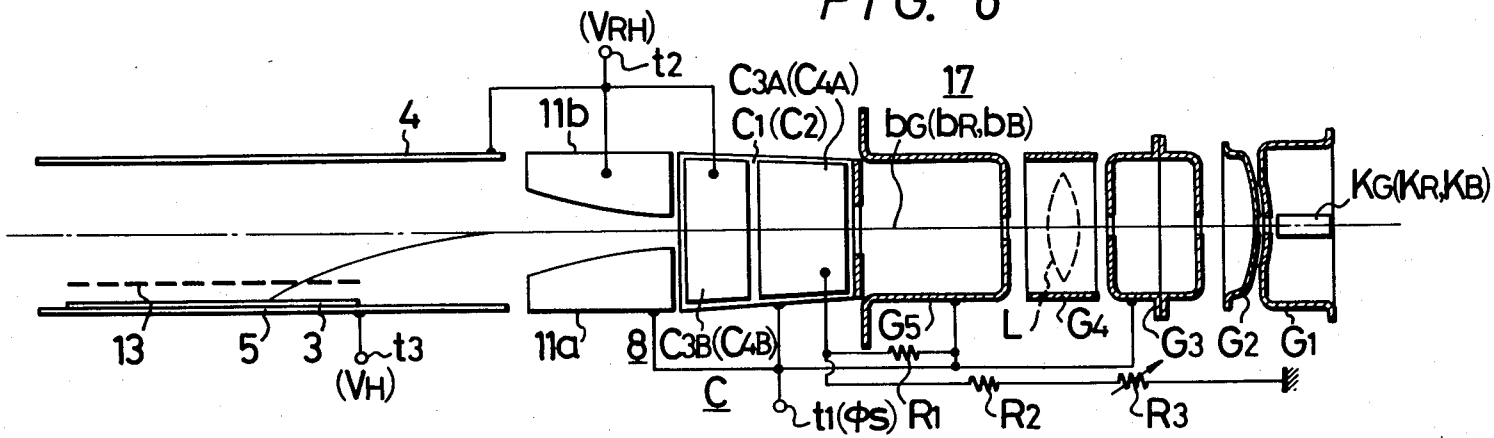
FIG. 6 is a partially cross-sectional other side view of the same.

With reference to FIGS. 5 and 6, an example in which a multi-beam electron gun according to the present invention is applied to the flat type color cathode ray tube shown in FIGS. 1 and 2 will be described. In the figures, reference numeral 17 generally designates the electron gun according to the present invention. In FIGS. 5 and 6, like parts corresponding to those of FIGS. 3 and 4 are marked with the same references and the overlapped explanation will be omitted. Also in this embodiment, the third grid $G_3$ and the fifth grid $G_5$ supplied with a high voltage of the same potential and the fourth grid $G_4$ constitute the main electron lens L of the unipotential type. The construction is not always limited to the above one. For example, the present invention can be applied to such a case that an electron gun is provided with first to fourth grids and the third and fourth grids constitute an electron lens of bipotential type.

In the present invention, the convergence means C for the above electron beams is formed by two pairs of deflection plates, namely, a pair of inner deflection plates facing to each other and a pair of outer deflection plates located outside of the inner deflection plates. Particularly one pair of deflection plates, in the example shown in FIGS. 5 and 6, the pair of outer deflection plates are respectively divided by two front and rear portion relative to the advancing direction of each of the electron beams $b_R$, $b_G$ and $b_B$ to thereby form deflection plates $C_{3A}$, $C_{3B}$ and $C_{4A}$, $C_{4B}$. The pair of inner deflection plates $C_1$ and $C_2$ of the convergence means C are electrically connected to each other to be the same in potential. Also, the outer deflection plates at the rear side relative to the advancing direction of the beam, namely, the pair of deflection plates $C_{3B}$ and $C_{4B}$ at the side adjoining the deflection means 8 are electrically connected to each other to be the same in potential. The other deflection plates $C_{3A}$ and $C_{4A}$ at the front stage side are electrically connected to each other to be the same in potential. And, the inner deflection plates $C_1$ and $C_2$ are connected to the high voltage electrodes at the last stage composing the main electron lens, namely, the fifth grid $G_5$ and the third grid $G_3$ which constitute the unipotential type main electron lens shown in the figure. As shown in FIG. 6, the inner deflection plates $C_1$ and $C_2$ are electrically connected to one deflection plate 11*a* of the horizontal and vertical deflection means 8 located at the side adjacent to the phosphor screen 3 and the target electrode 5, from which a terminal $t_1$, for example is led out. The outer deflection plates $C_{3B}$ and $C_{4B}$ of the convergence means C at the rear stage are electrically connected to the opposing electrode 4 and the other deflection plate 11*b* of the horizontal and vertical deflection means 8, from which a terminal $t_2$ is led out. Reference letter $t_3$ designates an applied voltage terminal for the target electrode 5, namely, the phosphor screen 3 to which a high voltage $V_H$, for example, voltage of 10 kV is applied. The terminal $t_2$ is applied with a voltage $V_{RH}$ lower than the high voltage $V_H$, for example, voltage of 6.5 kV. The terminal $t_1$ is applied with a voltage $\phi_s$ provided by superimposing a vertical deflection voltage for dynamic compensation $\pm\frac{1}{2}$ V$\alpha$ upon $V_{RH}\pm\frac{1}{2}$ V def when a vertical deflection voltage (peak-to-peak voltage) is taken as V def where the V def is selected in a range from, for example, 0.8 to 1 kV. The outer front deflection plates $C_{3A}$ and $C_{4A}$ of the convergence means C are connected through a dividing resistor $R_1$ to the terminal $t_1$ and grounded (cathode potential) through a fixed resistor $R_2$ as dividing resitors and a variable resistor $R_3$. As described above, the deflection plates $C_{3A}$ and $C_{4A}$ are applied with a voltage which is approximately 90% of the voltage applied to the terminal $t_1$. In addition, the fourth grid $G_4$ is applied with a voltage of, for example, 1.5 to 2 kV.

Figure 7:
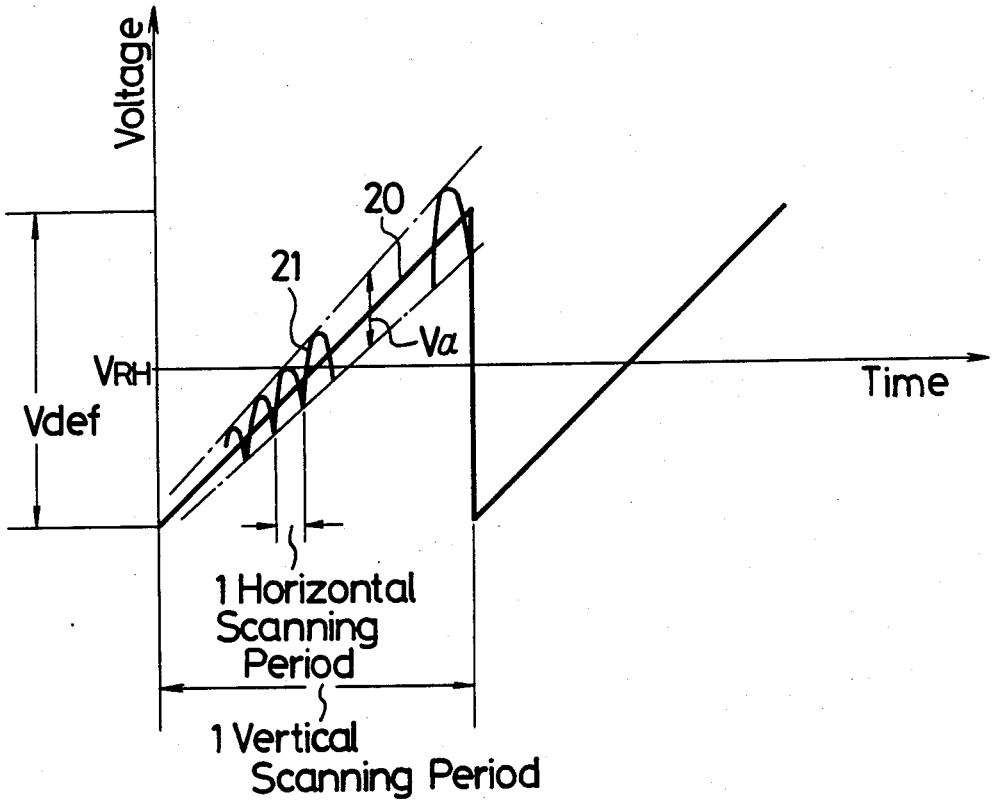
FIG. 7 is a graph of a deflecting voltage thereof.

FIG. 7 is a waveform diagram of the voltage which is applied across the deflecting plates 11*a* and 11*b*. This voltage is such one that a voltage V$\alpha$ of the parabolic-shaped compensating voltage signal 21 which compensates an arc distortion caused by the difference of the distance between each scanning position on the phosphor screen and the center of deflection is superimposed upon a sawtooth-shaped vertical deflection voltage signal 20. In this case, the amplitude of the compensating voltage signal 21 becomes larger as the vertical scanning position of the beam on the phosphor screen comes closer to the side of the electron gun.

With the above construction of the present invention, the dynamic convergence compensation can automatically be performed without applying particular dynamic convergence compensating signal. In the above convergence means C, the voltage between the fifth grid $G_5$, the inner deflection plates $C_1$, $C_2$ and the outer deflection plates $C_{3A}$ and $C_{4A}$ at the front side is always set to a predetermined ratio which is divided by the aforementioned resistors $R_1$, $R_2$ and $R_3$. Accordingly, even if the terminal $t_1$ is applied with the voltage $\phi_s$ which is fluctuated in a range of $V_{RH}\pm\frac{1}{2}$ V def $\pm\frac{1}{2}$ V$\alpha$, the tracings of the both side beams $b_R$ and $b_B$ passing through between the deflection plates $C_1$ and $C_{3A}$ and the deflection plates $C_2$ and $C_{3B}$ are not changhd due to the scaling law. More particularly, even if the voltage signal described with reference to FIG. 7 is applied to the fifth grid $G_5$ and the inner deflection plates $C_1$ and $C_2$, the both side beams $b_R$ and $b_B$ tend to converge to the center beam $b_G$ at a predetermined position. However, between the outer deflection plates $C_{3B}$, $C_{4B}$ of the rear stage to which the fixed voltage $V_{RH}$ is applied and the inner deflection plates $C_1$, $C_2$ is applied a voltage which is fluctuated in response to the vertical and horizontal scanning periods by a difference between the voltage signal shown in FIG. 7 and the voltage $V_{RH}$. At first, it is assumed that the convergence position is constant relative to the horizontal scanning direction. Considering the vertical scanning position on the phosphor screen 3 farthest from the electron gun, relative to the rear outer deflection plates $C_{3B}$ and $C_{4B}$ to which the fixed voltage $V_{RH}$ is applied, the inner deflection plates $C_1$ and $C_2$ are made largest in negative potential by the vertical deflection voltage signal 20. Thus, at that time, the convergence deflection of the both side beams $b_R$ and $b_B$ is weakened most so that the convergence position between them and the center beam $b_G$ is made farthest from the convergence means C. Conversely, considering the vertical scanning position on the phosphor screen 3 nearest to the electron gun, relative to the rear outer deflection plates $C_{3B}$ and $C_{4B}$ to which the fixed voltage $V_{RH}$ is applied, the inner deflection plates $C_1$ and $C_2$ are made largest in potential by the vertical deflection voltage signal 20. Accordingly, at that time, the convergence deflection of the both side beams $b_R$ and $b_B$ is made strongest so that the convergence position between them and the center beam $b_G$ is made nearest to the convergence means C. As mentioned above, as the distance corresponding to the vertical scanning position from the electron gun is changed, the convergence position of the beam is changed. As a result, the dynamic convergence compensation is automatically made so that each beam is converged at the beam throughhole of the electrode 13 which determines the beam landing position without fail. At the same time, regarding the position on the horizontal scanning direction, a distance between the deflection center of the deflection means 8 and the convergence position of the beam on the phosphor screen is made different depending on the center position and the positions farther from the center position to the left and right sides. Accordingly, the parabolic-shaped vertical deflection compensation signal 21 as shown in FIG. 7 is supplied to the defleciton means 8 so that the arc distortion corresponding to the horizontal scanning position is compensated. Even by the signal 21, the change of the electrical field of the vertical deflection compensating voltage signal 21 similarly occurs as above between the rear outer deflection plates $C_{3B}$ and $C_{4B}$ and the inner deflection plates $C_1$ and $C_2$ of the convergence means C in response to the horizontal scanning period and the convergence position of each beam is changed. Thus, the convergence compensation can automatically be made regarding the horizontal scanning position.

That is, at the center position on the horizontal scanning direction, relative to the rear outer deflection plates $C_{3B}$ and $C_{4B}$ to which the fixed voltage $V_{RH}$ is applied, the inner defleciton plates $C_1$ and $C_2$ are made to be high potential at the center of the parabolicshaped voltage of the above vertical deflection compensating voltage signal 21. Accordingly, the convergence deflection of the both side beams $b_R$ and $b_B$ is made strongest and the convergence position thereof to the center beam $b_G$ is made nearest to the convergence means C.

On the contrary, at the positions farthest from the center position on the horizontal scanning direciton to right and left sides, relative to the rear outer deflection plates $C_{3B}$ and $C_{4B}$ to which the fixed voltage $V_{RH}$ is applied, the inner deflection plates $C_1$ and $C_2$ are made to be low potential at the both ends of the parabolic-shaped voltage of the above vertical deflection compensating voltage signal 21. Accordingly, the convergence deflection of the both side beams $b_R$ and $b_B$ is weakened most and the convergence position thereof to center beam $b_G$ is made farthest from the convergence means C.

Figure 8:
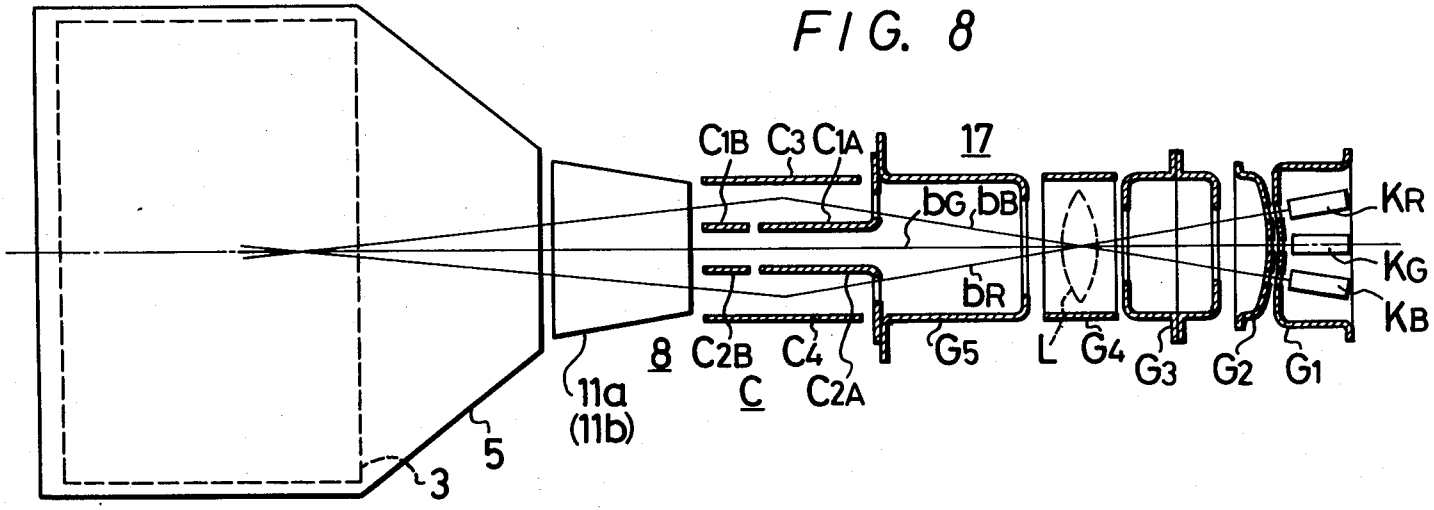
FIGS. 8 and 9 are partially cross-sectional one and the other side views of another embodiment of the present invention.
Figure 9:
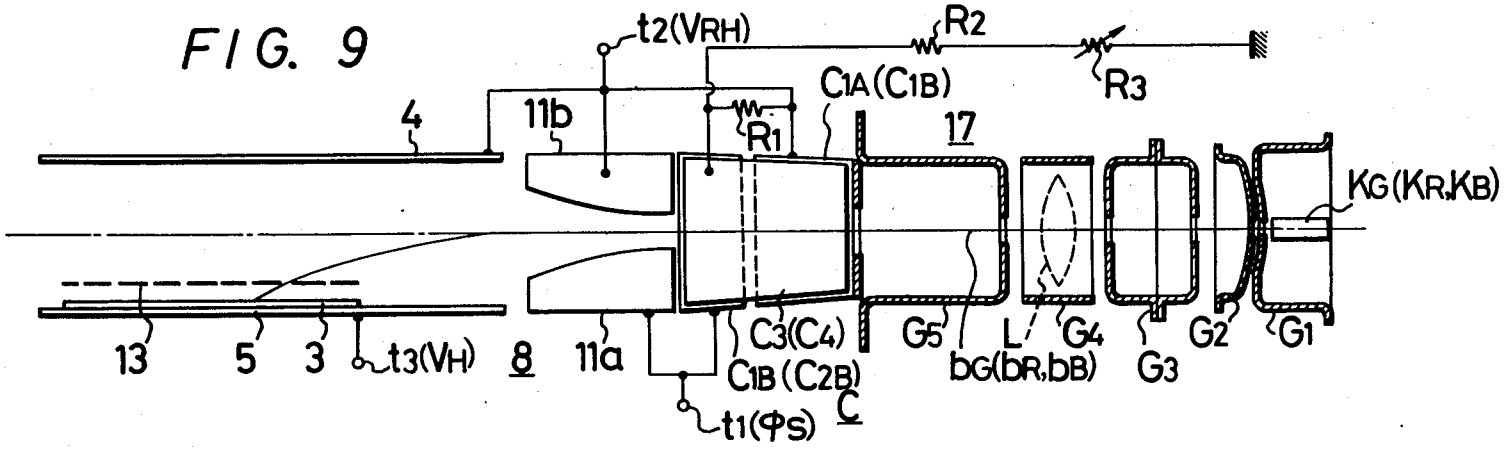

While in the example shown in FIGS. 5 and 6 the outer deflection plate of the convergence means C is divided into the front side one and the rear side one, it may be possible that as shown in FIGS. 8 and 9, the inner deflection plates $C_1$ and $C_2$ are formed by the deflection plates $C_{1A}$, $C_{1B}$ and $C_{2A}$, $C_{2B}$ which are provided by dividing the above inner deflection plates into the front side one and the rear side one. In FIGS. 8 and 9, like parts corresponding to those of FIGS. 5 and 6 are marked with the same references and the overlapped explanation will be omitted. In this case, the front side inner deflection plates $C_{1A}$ and $C_{2A}$ are connected to the fifth grid $G_5$, the third grid $G_3$, the opposing electrode 4 and the deflection plate 11*b* adjacent to the opposing electrode similarly as the example mentioned before. And, through the dividing resistor $R_1$ to the front side inner deflection plates $C_{1A}$ and $C_{2A}$ and further through the fixed resistor $R_2$ and the variable resistor $R_3$ to the cathode potential. The rear side inner deflection plates $C_{1B}$ and $C_{2B}$ are connected to the deflection plate 11*a*.

Also in this case, in the convergence means C, the voltage between the fifth grid $G_5$, the inner deflection plates $C_{1A}$ and $C_{2A}$ and the outer deflection plates $C_3$ and $C_4$ is set to the potential provided by dividing the fixed potential $V_{RH}$ by a predetermined ratio among the resistors $R_1$, $R_2$ and $R_3$. Accordingly, the both side beams $b_R$ and $b_B$ intend to be converged to the center beam $b_G$ at the predetermined position. However, between the rear side inner deflection plates $C_{1B}$, $C_{2B}$ and the outer deflection plates $C_3$, $C_4$ is supplied such a voltage which corresponds to a difference between the voltage signal shown in FIG. 7 and a voltage provided by dividing the fixed potential $V_{RH}$ by the predetermined ratio among the resistors $R_1$, $R_2$ and $R_3$ and which is changed in response to the vertical and horizontal scanning periods.

First, it is assumed that the convergence position is constant relative to the horizontal scanning direction. Considering the vertical scanning position on the phosphor screen 3 farthest from the electron gun, relative to the outer deflection plates $C_3$ and $C_4$ to which the potential provided by dividing the fixed potential $V_{RH}$ by the predetermined ratio among the resistors $R_1$, $R_2$ and $R_3$ is applied, the rear side inner defleciton plates $C_{1B}$ and $C_{2B}$ are made largest in negative potential by the vertical deflection voltage signal 20. Thus, at that time, the convergence deflection of the both sides beams $b_R$ and $b_B$ is weakened most and the convergence position to the center beam $b_G$ is made farthest from the convergence means C. On the contrary, at the vertical scanning position on the phosphor screen 3 nearest to the electron gun, relative to the outer deflection plates $C_3$ and $C_4$ to which the potential provided by dividing the fixed potential $V_{RH}$ by the predetermined ratio among the resistors $R_1$, $R_2$ and $R_3$ is applied, the rear side inner deflection plates $C_{1B}$ and $C_{2B}$ are made in deepest positive potential by the vertical deflection voltage signal 20. Accordingly, at that time, the convergence deflection of the both side beams $b_R$ and $b_B$ is made strongest and the convergence position thereof to the center beam $b_G$ is made nearest to the convergence means C. As mentioned above, as the distance from the electron gun to the corresponding vertical scanning position is changed, the convergence position of the beam is changed. In consequence, the dynamic convergence compensation is automatically carried out so that each beam is converged at the beam through-hole of the electrode 13 which determines the beam landing position without fail. At the same time, regarding the position on the horizontal scanning direction, the distance between the deflection center of the deflection means 8 and the beam convergence position on the phosphor screen is different depending on the center position and the position farther from the center position to right and left sides. Accordingly, the parabolic-shaped vertical deflection compensating voltage signal 21 as shown in FIG. 7 is applied to the deflection means 8 and the arc distortion corresponding to the horizontal scanning position is compensated. Even by this signal 21, the change of the electric field of the vertical deflection compensating voltage signal 21 similarly occurs as above between the outer deflection plates $C_3$, $C_4$ of the convergence means C to which the potential provided by dividing the fixed potential $V_{RH}$ by the predetermined ratio among the resistors $R_1$, $R_2$ and $R_3$ is applied and the rear side inner deflection plates $C_{1B}$ and $C_{2B}$ in response to the horizontal scanning period and then the convergence position of each beam is changed. Thus, the convergence compensation can automatically be made relative to the horizontal scanning position.

I claim:

1. In a multi-beam electron gun for use with a flat type cathode ray tube having a phosphor screen with an electrode determining a landing position of an electron beam from said electron gun and an opening electrode provided in a flat tube envelope in facing relation so as to form a first deflecting system therebetween, a multi-beam electron gun located in the extended direction parallel to said phosphor screen providing a plurality of electron beams and a second deflecting system located between said multi-base electron gun and said first deflecting system providing horizontal scanning deflection of the beams in the direction substantially perpendicular to the axial direction of the beams and parallel to the surface of said screen and providing vertical scanning deflection of the beams in the direction perpendicular to the horizontal deflection to deflect the beam in cooperation with said first deflecting system onto said screen, the plurality of electron beams being intersected with one another at approximately the center of a main electron lens which carries out substantial focusing of said electron beams in said electron gun, said plurality of electron beams passed through said main electron lens being converged by front and rear convergence means onto said determining electrode, and a predetermined potential being applied to at least one of said front and rear convergence means to thereby carry out dynamic convergence compensation of said plurality of electron beams.

* * * * *